United States Patent [19]

Brierley et al.

[11] 4,271,030

[45] Jun. 2, 1981

[54] POURABLE LIQUID COMPOSITIONS

[75] Inventors: John M. Brierley, Wirral; John S. Parsons, Deeside; James R. Trueman; Robert A. Jones, both of Wirral, all of England

[73] Assignee: Lever Brothers Company, New York, N.Y.

[21] Appl. No.: 961,793

[22] Filed: Nov. 17, 1978

[30] Foreign Application Priority Data

Nov. 18, 1977 [GB] United Kingdom ..... 48108/77
Jun. 16, 1978 [GB] United Kingdom ..... 27176/78

[51] Int. Cl.[3] ..... C11D 3/14; C11D 3/395; C11D 11/04; C11D 17/08

[52] U.S. Cl. ..... 252/98; 8/527; 8/528; 8/645; 252/95; 252/96; 252/99; 252/102; 252/103; 252/133; 252/173; 252/174.25; 252/187 H; 252/DIG. 14

[58] Field of Search ..... 252/95, 96, 99, 102, 252/103, 174.25, 187 H, 98, 173; 8/77, 108 R, 108 A, 525, 527, 528, 645

[56] References Cited

U.S. PATENT DOCUMENTS

| | | | |
|---|---|---|---|
| 3,179,597 | 4/1965 | Mankowich | 252/125 |
| 3,684,722 | 8/1972 | Hynam | 252/98 |
| 3,689,421 | 9/1972 | Briggs | 252/95 |
| 3,956,158 | 5/1976 | Donaldson | 252/102 |
| 4,005,027 | 1/1977 | Hartman | 252/95 |
| 4,006,091 | 2/1977 | Lindblom | 252/90 |
| 4,051,056 | 9/1977 | Hartman | 252/99 |
| 4,154,694 | 5/1979 | Donaldson | 252/98 |
| 4,158,553 | 6/1979 | Chapman | 252/96 X |

FOREIGN PATENT DOCUMENTS

| | | | |
|---|---|---|---|
| 514761 | 7/1955 | Canada | 8/77 |
| 176747 | 9/1922 | United Kingdom | 8/77 |
| 1181607 | 2/1970 | United Kingdom . | |
| 1262280 | 2/1972 | United Kingdom . | |
| 1308190 | 2/1973 | United Kingdom . | |
| 1466560 | 3/1977 | United Kingdom . | |

OTHER PUBLICATIONS

Sagarin, E.: Cosmetics–Science and Technology, published by Interscience Publishers, Inc., New York, 1957, p. 250.

*Primary Examiner*—Dennis L. Albrecht
*Attorney, Agent, or Firm*—James J. Farrell; Melvin H. Kurtz; Irving N. Feit

[57] ABSTRACT

A colored liquid hypochlorite bleach composition is provided, comprising a particulate pigment such as Ultramarine Blue, which is stably suspended in the composition by means of a flocculate, such as calcium soap flocs.

18 Claims, No Drawings

POURABLE LIQUID COMPOSITIONS

This invention relates to pourable, coloured liquid bleach compositions and processes for preparing them. It particularly relates to such compositions in which a particulate, bleach-stable pigment is stably suspended for a normally acceptable period of storage.

Liquid bleach compositions, e.g. aqueous hypochlorite solutions, are valuable as bleaching and disinfecting agents, especially for lavatory pans. They are poisonous and caustic materials that have to be used with care, and, as with other such materials, it is desirable to give them a distinct appearance by colouring them. The choice of colouring additive available for this purpose is very limited, not only because most dyes are decomposed by the strongly oxidising environment, but most non-oxidisable inorganic substances whose colour depends on the presence of transition metals catalyse the decomposition of the hypochlorite. Hitherto, coloured commercial hypochlorite compositions have been limited to those containing small quantities of dissolved potassium permanganate and potassium dichromate, but the purple and yellow solutions which these salts provide are aesthetically unattractive.

Although there have been prior proposals in the art to colour a liquid bleach composition, these have not been satisfactory, because either the dye used is not sufficiently bleach-stable, or the pigment used is not sufficiently stably suspended, or if sufficiently stably suspended, the water-dispersibility of the composition is negatively influenced, or because the suspending system is decomposed by the bleach component.

Thus, attempts have been to use the inorganic silicate pigment known as ultramarine blue to colour hypochlorite solutions. Although this material is inert to hypochlorite oxidation and does not catalyse decomposition of hypochlorite, it is insoluble and requires suspension in the hypochlorite solution. Such suspension cannot be achieved merely by dispersing particles of ultramarine blue in hypochlorite solution, because the pigment has a density of 2.35 and settles out even when it is of very fine particle size. Even where thickened hypochlorite solutions such as those described in British Pat. No. 1,329,086 are employed the pigment is not maintained in suspension for a satisfactory period. The problem is therefore to find a system which can be employed to stably suspend the pigment.

It has now been found that coloured liquid bleach compositions having a good water-dispersibility can be obtained, in which bleach-stable pigments are stably suspended, by providing in the composition a carrier phase for the pigment particles, said carrier phase having a floc-structure. By floc-structure is meant an aggregate of smaller particles of organic or inorganic material, obtained by flocculation. Flocculation is a well-known technique, it causes coalescence of separate particles into clusters or flocs.

It has been found that by the provision of a carrier phase having a floc-structure in the liquid bleach composition, the pigment particles can be stably suspended therein.

In its broadest sense, the present invention therefore provides a coloured liquid bleach composition, comprising an aqueous phase in which a bleach-stable particulate pigment is stably suspended by means of a carrier phase having a floc-structure, said composition having no appreciable yield stress value, i.e. less than 1 dyne/cm$^2$ at 20° C. it is highly desirable that the composition has a good water-dispersibility, which can be jeopardized by a yield stress value.

The composition of the invention may contain an oxygen- or chlorine-bleaching agent, such as $H_2O_2$ or hypochlorite. Chlorine bleaching agents are preferred. Such compositions normally have an alkaline pH, and a certain electrolyte content. The present invention is particularly suitable to colour such compositions.

Although the present invention is suitable to colour liquid bleach compositions which have no significant viscosity, it is particularly useful for so-called thickened bleach compositions of the type as e.g. disclosed in British Pat. Nos. 1,329,086 and 1,466,560.

The carrier phase in floc-structure can be obtained in situ in the liquid bleach composition, e.g. by precipitating and flocculating in the composition under controlled conditions an organic or inorganic material with a suitable electrolyte, or the carrier phase can be made separately. Thus the carrier phase can be made, e.g. by preparing an aqueous system wherein a material is flocculated with the aid of an electrolyte.

The floc-structure depends on a number of factors, such as nature of particles, its size and shape, the aqueous phase, concentration of suspended solids, temperature, number of collisions, etc.

In essence, the bleach-stable pigment particles are suspended in a liquid medium, e.g. an aqueous medium, by providing a flocculated particle system therein which has a certain floc volume, preferably a high floc volume. The systems have to fulfil three criteria, to wit:

(1) the pigment particles must be held and carried by the flocs;

(2) the flocs must fill a large proportion of the volume of the liquid medium, i.e. at least 50% thereof;

(3) the system must have no appreciable yield stress value.

Criterion 1 can be fulfilled by forming the flocs in situ by e.g. precipitation in the liquid medium. Although the flocs may also be made separately, and then added to the liquid medium, this may, with certain materials such as polymer latices, suspend the pigments less readily.

The particles forming the flocs should preferably be irregular so that they come together to form loose floc-like aggregates. Needle-shaped crystals are particularly favoured, although platelets may also be satisfactory. There is an optimum crystal size, since crystals which are too small tend to pack more easily, whilst crystals that are too large do not readily form flocs and occupy too little space.

As to criterion 2, the floc-structure, and consequently the amount of carrier phase in the composition should be such that it provides for a stable suspension of the pigment particles. Normally the amount will be such that the flocculate will fill the space of the aqueous medium in which it is formed to the level at which the volume of flocculate is self-sustaining. In theory the amount of material in the flocs can be increased until it fills the whole volume. However, if the flocculated layers are too dense, they are not readily pourable, and the yield value criterion may thereby not always be met.

As to the liquid medium in which the flocs are present, the crystal growth control therein, if the floc-particles are produced by precipitation in situ, and the chemical nature of the liquid medium are important. Ionic strength, common ion concentration, pH, presence of soluble detergent active compounds, etc. are important factors. Usually a large amount of electrolyte is present from the bleach, and this will usually be an advantage as it reduces the solubility of the precipitating component.

The most stable systems are produced when the density of the base liquid is closely matched to that of the flocs. This can be achieved by altering the base liquid density by changing the electrolyte level, or by altering the apparent floc density by processing, use of calcium instead of sodium ions, etc.

The viscosity of the composition can be controlled by using a thickened liquid medium. This may also aid stability by slowing sedimentation rates.

The materials from which the floc-structure is obtained can be either organic or inorganic. Very satisfactory materials are precipirated detergent active materials. The active material should have a low solubility in high-electrolyte solutions at room temperature. It has been found that those actives which crystallize readily when salted out give optimum results. Examples thereof are the primary alkylsulphates and alkylsulphonates. Other actives such as alkylarylsulphonates and sec.-alkylsulphates may also be used, but as they tend to form mesomorphic phases, their use is less optimal. Examples of suitable detergent actives are sodium $C_{10}$–$C_{18}$ alkylsulphates such as sodium dodecylsulphate, sodium tallow alcoholsulphate, sodium $C_{10}$–$C_{18}$ alkanesulphonates, such as sodium 2-hydroxytetradecane-1-sulphonate, sodium hexadecyl-1-sulphonate; sodium $C_{12}$–$C_{18}$ alkylbenzenesulphonates such as sodium dodecylbenzenesulphonate. Instead of the sodium salts, other salts can also be used; including the corresponding calcium salts.

The stability of systems with actives can be improved with a small amount of a soluble detergent active, such as a tertiary amine oxide or a diphenylethersulphonate.

A particular preferred material is a calcium fatty acid soap flocculate, and this preferred embodiment will be described hereafter in more detail.

Inorganic precipitates may also be used, although they give less satisfactory products in comparison with detergent active-based systems, since it is more difficult to match the density of the inorganic crystals with that of the liquid medium, the inorganic crystals being denser.

Examples of suitable inorganic materials are magnesiumhydroxide, calciumchloride, aluminium hydroxide, sodium orthophosphate, tetrasodiumpyrophosphate, sodium metasilicate. Other suitable inorganic materials are clays, such as Laponite Clay, and other suitable organic materials are insoluble polymers such as PMMA (polymethylmethacrylic acid) latices.

The amount of material from which the floc-structure is obtained is from 0.05–20, preferably 0.1–10% by weight of the composition.

As stated above, a particularly preferred embodiment of the present invention is the use of a calcium fatty acid soap flocculate. The present invention therefore also and preferably relates to a pourable liquid bleach composition comprising a calcium fatty acid soap flocculate dispersed in an aqueous medium and a particulate pigment maintained in suspension by the flocculate.

The calcium fatty acid soap is preferably the calcium salt of a fatty acid having from 8 to 22 carbon atoms, and especially a saturated fatty acid, for example lauric, myristic, palmitic or stearic acid, or mixtures of such acids. The flocculate form of such a soap, which can readily be produced by the addition of an aqueous solution of a soluble calcium salt, for instance calcium chloride, to an aqueous solution of a soluble soap of the fatty acid concerned, for instance an alkali metal salt of the fatty acid, such as the sodium salt, can be readily recognised by its characteristic habit seen under a microscope, where aggregates of very finely divided solid particles can be seen. Such a flocculate pervades an aqueous medium in which it is formed, settling in such a way as to fill the space occupied by the aqueous medium to the level at which the volume of flocculate is self-sustaining. The minimum concentration of calcium soap required is thus the minimum required to fill the medium: the maximum concentration possible is that at which the aqueous medium still remains a pourable liquid. Generally the amount of calcium soap present in a composition will be from 0.05 to 10% and preferably it is from 0.1 to 5%, by weight.

It is preferable to stabilise the calcium soap flocculate in dispersion by detergent micelles, especially a detergent micellar complex, in solution in the aqueous medium. Solutions of detergent micellar complexes, which contain at least two surfactants of different type, are well known in the detergent art and typical examples are those formed in aqueous solutions between alkali metal fatty acid soaps and either amine oxide or betaine surfactants. Suitable alkali metal fatty acid soaps are the alkali metal salts, for instance the sodium salts, of fatty acids having from 8 to 22 carbon atoms such as those referred to above. Amine oxide surfactants are typically of the structure $R_2R'NO$, in which each R is a lower alkyl group, for instance methyl, and R' is a long chain alkyl group having from 8 to 22 carbon atoms, for instance a lauryl, myristyl, palmityl or cetyl group. Instead of an amine oxide, a corresponding surfactant phosphine oxide $R_2R'PO$ or sulphoxide RR'SO can be employed. Betaine surfactants are typically of the structure $R_2R'N^+R''COO^-$, in which each R is a lower alkyl group, R' is a long chain alkyl group as above and R'' is an alkylene group having from 1 to 3 carbon atoms. Specific examples of these surfactants are lauryldimethylamine oxide, myristyldimethylamine oxide, cocodimethylamine oxide, hardened tallow dimethylamine oxide, the corresponding phosphine oxides and sulphoxides, and the corresponding long chain alkyl dimethyl carboxyethylamine betaines. Other detergent micellar complexes that can be employed are those provided by surfactant mixtures described in British Pat. Nos. 1,167,597, 1,181,607, 1,262,280 and 1,308,190 and U.S. Pat. Nos. 3,579,456 and 3,623,990.

The concentration of surfactants employed in the preferred composition of the invention will be above the critical micellar concentration (CMC) so that detergent micelles are present in the aqueous medium, and the medium has an increased viscosity. This latter concentration depends on the particular surfactant mixture present in solution, as well as the concentration of inorganic ions present, but it will in general be from 0.5% by weight of the aqueous medium, up to the limit of solubility. Care must be taken to choose the relative proportions of surfactants forming the micelles such that the aqueous medium is homogeneous and does not separate into two liquid phases: the proportions required will depend on the specific ingredients employed. Where a detergent micellar complex is that from an amine oxide and an alkali metal soap, the total amount of amine oxide present is preferably from 0.3 to 5% by weight of the composition and the molecular ratio of alkali metal soap to amine oxide present is from 0.05:1 to 0.8:1.

Compositions in which the aqueous medium contains a hypochlorite in solution are particularly valuable. Normally the hypochlorite will be present as an alkali metal salt, for instance the lithium or potassium salt, and especially the sodium salt. The composition can contain from 0.1 to 15% of "available" chlorine; a composition containing X% "available" chlorine is one that releases X parts of chlorine by weight on acidification of 100 parts of the solution with excess hydrochloric acid, and where the hypochlorite is sodium hypochlorite and the solution contains 10% of available chlorine this is equivalent to the presence of 10.5% by weight of sodium hypochlorite. Preferably a composition of the invention contains from 1 to 15% by weight of available chlorine. Where a composition contains hypochlorite, all ingredients present in the composition must be sufficiently resistant to hypochlorite oxidation for the composition to have a useful life. Thus, when a calcium soap and any other soap is employed, it will be that of a fatty acid stable to hypochlorite oxidation, and saturated fatty acids are accordingly essential. The contribution of the hypochlorite to the inorganic ion concentration of a composition requires to be taken into account in ensuring that the detergent micellar complexes are formed.

The particle sizes of the particulare solid maintained in suspension by the flocculate will in general be within the range from 0.1 to 50 microns (in diameter). Suitable particulate solids are pigments such as Ultramarine blue and phthalocyanines. White pigments, for instance titanium dioxide, can be employed, and are useful as opacifiers. The density of the particularte solid is not critical provided its particle size is small enough: both pigments that are more dense and those that are less dense than the aqueous medium can be employed. Finely divided ultramarine blue consisting of particles within the range of from 0.1 to 5 microns diameter can be employed, and one with a mean particle size of about 1 micron and particle sizes within the range from 0.5 to 3 is particularly satisfactory. Such a pigment provides an intense colouration, and it is only necessary to use a quantity sufficient to give the colour desired: an effective amount of this or other pigment is generally from 0.01 to 0.2% by weight of the composition. The maximum amount of particulate solid that a particular composition will maintain in suspension will depend on the constituents of the composition, and can be found by simple testing.

The viscosity of a composition of the invention will depend on its ingredients, but where the composition contains hypochlorite and is to be employed as a bleaching agent and disinfectant for lavatory pans it is generally useful to arrange for the composition to have a viscosity of from 5 to 500 centiPoise at 25° C. measured at a shear rate of 21 sec.$^{-1}$, and this can be provided by the presence of detergent micellar complexes as described above. Particularly valuable in this connection are the thickened hypochlorite bleaching compositions described in British Pat. No. 1,329,086, which contain detergent micellar complexes derived from alkali metal fatty acid soaps and amine oxides or betaines, and which also contain calcium soap flocculates and particulate solids maintained in suspension by them according to the present invention. Other suitable thickened systems in which the present invention may be used are hypochlorite systems, thickened with fatty acid sarcosinates and hypochlorite soluble detergent actives, or with fatty acid sugar esters and hypochlorite soluble detergent actives, e.g. as described in British Pat. No. 1,466,560 and Dutch Patent Application No. 7605328.

Especially valuable are hypochlorite-containing compositions of the present invention that have a viscosity of from 20 to 400 CentiPoise, as these are readily dispersible in the water contained in a lavatory pan, as well as adhering to the inclined surfaces of a lavatory pan that are above the water and therefore not in contact with the water-diluted composition.

An alkali metal benzene, toluene or xylene sulphonate can be included in a composition of the invention in small amounts, for instance 0.1 to 3% by weight, to reduce viscosity and increase the cloud point of the preferred Ca-soap containing composition and thus make it less liable to phase separation: this generally enables useful formulations to be made with high concentrations of e.g. calcium soap and without undesirably high viscosity or with high concentrations of sodium soap and without poor stability at high temperature.

Perfumes can be included in compositions of the invention with due allowance for their effect on micellar complex formation and the need to choose a hypochlorite-stable perfume where the composition contains hypochlorite.

A process of the invention is one for preparing the preferred composition of the invention by formulating the ingredients, in which there is included the step of precipitating the calcium soap as a flocculate. Preferably this is effected by a step of adding an aqueous solution of a water-soluble calcium salt, for instance, calcium chloride, to an aqueous solution of an alkali metal salt of the corresponding fatty acid containing the components of any micellar complex to be present in the composition: preferably where hypochlorite is to be present in the composition, the calcium salt solution is added after the hypochlorite. Where there is also to be present in the final composition such an alkali metal fatty acid salt, for instance as part of a detergent micellar complex, all that is necessary is to employ sufficient excess of alkali metal fatty acid salt to provide the amount of calcium soap and residual alkali metal fatty acid salt required.

In order to stabilise hypochlorite in a composition of the invention containing it, it is important to ensure that the pH of the final composition is above 9.8, preferably at least 10.5, and where necessary additional alkali is employed to secure this.

The invention is illustrated by the following Examples, in which amounts are by weight and temperatures are in °C. The Ultramarine blue referred to in the Examples is one having a mean particle size of 0.94 microns and a range of particle sizes of from 0.5 to 3 microns. The cocodimethylamine oxide is one having a molecular weight of 237 and a "coconut alkyl" group with a content of 4% $C_{10}$, 68% $C_{12}$, 23% $C_{14}$ and 5% $C_{16}$ n-alkyl radicals.

EXAMPLES 1 TO 82

Compositions were prepared from the following ingredients.

| | Parts |
|---|---|
| Aqueous solution containing | 20 |
| sodium laurate | A |
| sodium hydroxide | 0.36 |
| 30% Aqueous cocodimethylamine oxide solution | B |

-continued

| | Parts |
|---|---|
| Perfume (hypochlorite-stable) | 0.1 |
| Dispersion in 30% aqueous cocodimethylamine oxide solution | 0.5B |
| of ultramarine blue | 0.05 |
| 47% Aqueous alkaline sodium silicate solution ($2SiO_2:1Na_2O$) | 0.11 |
| Water | C |
| Aqueous sodium hypochlorite solution with 15% available chlorine | 40 |
| containing sodium hydroxide | 0.18 |
| 9.1 Aqueous calcium chloride solution | D |
| | 100 |

The amounts A, B, C and D employed were as set out in the Table below. To the sodium laurate solution heated sufficiently to avoid gel formation and cooled to 30° before addition of perfume was added in turn each of the remaining ingredients in the order given with stirring. Each product was a pourable turbid blue liquid composition containing calcium laurate flocculate filling the whole volume of the composition. The viscosities of most compositions were measured at 25° C. and are given in the Table as that using a Haake rotary viscometer at a shear rate of 21 sec.$^{-1}$. None of the compositions exhibited an appreciable yield stress value. Each composition was stable, the Ultramarine blue remaining wholly in suspension after standing at ambient temperature for at least 1 month.

| Example No. | Amount of ingredients (Parts) A | B | C | D | Product composition (%) Amine oxide | Calcium soap | Sodium soap | Mole Ratio Sodium soap: Amine oxide | Viscosity (cP) |
|---|---|---|---|---|---|---|---|---|---|
| 1 | 0.6 ) | | | | | | (0.4 | 0.41 | 46 |
| 2 | 0.65) | 2.33 | 35.69 | 0.55 | 1.05 | 0.2 | (0.45 | 0.46 | 66 |
| 3 | 0.7 ) | | | | | | (0.5 | 0.51 | 41 |
| 4 | 0.75) | | | | | | (0.55 | 0.44 | 86 |
| 5 | 0.8 ) | | | | | | (0.6 | 0.47 | 122 |
| 6 | 0.85) | 3.0 | 34.69 | 0.55 | 1.35 | 0.2 | (0.65 | 0.51 | 133 |
| 7 | 0.9 ) | | | | | | (0.7 | 0.55 | 127 |
| 8 | 0.95) | | | | | | (0.75 | 0.59 | 109 |
| 9 | 1.0 ) | | | | | | (0.8 | 0.63 | 100 |
| 10 | 0.85) | | | | | | (0.65 | 0.42 | 117 |
| 11 | 0.9 ) | | | | | | (0.7 | 0.45 | 149 |
| 12 | 0.95) | | | | | | (0.75 | 0.49 | 168 |
| 13 | 1.0 ) | 3.67 | 33.69 | 0.55 | 1.65 | 0.2 | (0.8 | 0.52 | 155 |
| 14 | 1.05) | | | | | | (0.85 | 0.55 | 184 |
| 15 | 1.1 ) | | | | | | (0.9 | 0.58 | 153 |
| 16 | 1.15) | | | | | | (0.95 | 0.61 | 132 |
| 17 | 1.2 ) | | | | | | (1.0 | 0.65 | 113 |
| 18 | 0.65) | | | | | | (0.25 | 0.25 | — |
| 19 | 0.7 ) | | | | | | (0.3 | 0.31 | — |
| 20 | 0.75) | 2.33 | 35.14 | 1.1 | 1.05 | 0.4 | (0.35 | 0.36 | — |
| 21 | 0.8 ) | | | | | | (0.4 | 0.41 | 96 |
| 22 | 0.85) | | | | | | (0.45 | 0.46 | 87 |
| 23 | 0.9 ) | | | | | | (0.5 | 0.51 | 21 |
| 24 | 0.95) | | | | | | (0.55 | 0.56 | — |
| 25 | 0.8 ) | | | | | | (0.4 | 0.32 | 30 |
| 26 | 0.85) | | | | | | (0.45 | 0.36 | 50 |
| 27 | 0.9 ) | | | | | | (0.5 | 0.40 | 83 |
| 28 | 0.95) | 3.0 | 34.14 | 1.1 | 1.35 | 0.4 | (0.55 | 0.44 | 120 |
| 29 | 1.0 ) | | | | | | (0.6 | 0.47 | 179 |
| 30 | 1.05) | | | | | | (0.65 | 0.51 | 168 |
| 31 | 1.1 ) | | | | | | (0.7 | 0.55 | 155 |
| 32 | 1.15) | | | | | | (0.75 | 0.59 | 129 |
| 33 | 0.85) | | | | | | (0.45 | 0.29 | — |
| 34 | 0.9 ) | | | | | | (0.5 | 0.32 | 64 |
| 35 | 0.95) | | | | | | (0.55 | 0.36 | 46 |
| 36 | 1.0 ) | | | | | | (0.6 | 0.39 | 40 |
| 37 | 1.05) | | | | | | (0.65 | 0.42 | 117 |
| 38 | 1.1 ) | | | | | | (0.7 | 0.45 | 166 |
| 39 | 1.15) | 3.67 | 33.14 | 1.1 | 1.65 | 0.4 | (0.75 | 0.49 | 153 |
| 40 | 1.2 ) | | | | | | (0.8 | 0.52 | 107 |
| 41 | 1.25) | | | | | | (0.85 | 0.55 | 333 |
| 42 | 1.3 ) | | | | | | (0.9 | 0.58 | 319 |
| 43 | 1.35) | | | | | | (0.95 | 0.61 | 319 |
| 44 | 1.4 ) | | | | | | (1.0 | 0.65 | 202 |
| 45 | 0.8 ) | | | | | | (0.2 | 0.20 | 30 |
| 46 | 0.85) | | | | | | (0.25 | 0.25 | 20 |
| 47 | 0.9 ) | | | | | | (0.3 | 0.31 | 20 |
| 48 | 0.95) | | | | | | (0.35 | 0.36 | 38 |
| 49 | 1.0 ) | 2.33 | 34.59 | 1.65 | 1.05 | 0.6 | (0.4 | 0.41 | 71 |
| 50 | 1.05) | | | | | | (0.45 | 0.46 | 133 |
| 51 | 1.1 ) | | | | | | (0.5 | 0.51 | 167 |
| 52 | 1.15) | | | | | | (0.55 | 0.56 | 150 |
| 53 | 1.2 ) | | | | | | (0.6 | 0.61 | 55 |
| 54 | 0.85) | | | | | | (0.25 | 0.20 | 35 |
| 55 | 0.9 ) | | | | | | (0.3 | 0.24 | 34 |
| 56 | 0.95) | | | | | | (0.35 | 0.28 | 34 |
| 57 | 1.0 ) | | | | | | (0.4 | 0.32 | 35 |
| 58 | 1.05) | | | | | | (0.45 | 0.36 | 46 |
| 59 | 1.1 ) | | | | | | (0.5 | 0.40 | 99 |
| 60 | 1.15) | 3.0 | 33.59 | 1.65 | 1.35 | 0.6 | (0.55 | 0.44 | 150 |

-continued

| Example No. | Amount of ingredients (Parts) A | B | C | D | Product composition (%) Amine oxide | Calcium soap | Sodium soap | Mole Ratio Sodium soap: Amine oxide | Viscosity (cP) |
|---|---|---|---|---|---|---|---|---|---|
| 61 | 1.2 ) | | | | | | (0.6 | 0.47 | 221 |
| 62 | 1.25) | | | | | | (0.65 | 0.51 | 226 |
| 63 | 1.3 ) | | | | | | (0.7 | 0.55 | 221 |
| 64 | 1.35) | | | | | | (0.75 | 0.59 | 184 |
| 65 | 1.4 ) | | | | | | (0.8 | 0.63 | 119 |
| 66 | 1.45) | | | | | | (0.85 | 0.67 | 28 |
| 67 | 0.8 ) | | | | | | (0.2 | 0.13 | — |
| 68 | 0.85) | | | | | | (0.25 | 0.16 | — |
| 69 | 0.9 ) | | | | | | (0.3 | 0.20 | — |
| 70 | 0.95) | | | | | | (0.35 | 0.23 | — |
| 71 | 1.0 ) | | | | | | (0.4 | 0.26 | 37 |
| 72 | 10.5) | | | | | | (0.45 | 0.29 | — |
| 73 | 1.1 ) | | | | | | (0.5 | 0.32 | 41 |
| 74 | 1.15) | | | | | | (0.55 | 0.36 | — |
| 75 | 1.2 ) | | | | | | (0.6 | 0.39 | 136 |
| 76 | 1.25) | 3.67 | 32.59 | 1.65 | 1.65 | 0.6 | (0.65 | 0.42 | — |
| 77 | 1.3 ) | | | | | | (0.7 | 0.45 | 315 |
| 78 | 1.35) | | | | | | (0.75 | 0.49 | — |
| 79 | 1.4 ) | | | | | | (0.8 | 0.52 | 366 |
| 80 | 1.45) | | | | | | (0.85 | 0.55 | — |
| 81 | 1.5 ) | | | | | | (0.9 | 0.58 | 235 |
| 82 | 1.55) | | | | | | (0.95 | 0.61 | — |

EXAMPLES 83 to 85

Stable pourable liquid compositions were prepared in the same way as in the previous Examples, but using the following ingredients.

| | Example No. 83 Parts | 84 Parts | 85 Parts |
|---|---|---|---|
| Aqueous solution containing | 20 | 20 | 20 |
| sodium laurate | 0.5 | 0.5 | 1.6 |
| sodium stearate | 0.4 | — | — |
| sodium hydroxide | 0.46 | 0.24 | 0.36 |
| 30% Aqueous cocodimethylamine oxide solution | 3.0 | 3.0 | 3.67 |
| Perfume (hypochlorite-stable) | 0.1 | 0.1 | 0.1 |
| Dispersion in 30% aqueous cocodimethylamine oxide solution | 1.5 | 1.5 | 1.83 |
| of ultramarine blue | 0.05 | 0.05 | 0.03 |
| 47% Aqueous alkaline sodium silicate solution ($2SiO_2$:$1Na_2O$) | 0.11 | 0.11 | 0.11 |
| Water | 34.44 | 7.99 | 31.86 |
| Sodium toluene p-sulphonate | — | — | 0.75 |
| Aqueous sodium hypochlorite solution with 15% available chlorine containing sodium | 40 | 66.7 | 40 |
| hydroxide | 0.18 | 0.3 | 0.18 |
| 9.1% Aqeuous calcium chloride solution | 0.80 | 0.55 | 1.65 |
| | 100 | 100 | 100 |
| Amine oxide % | 4.5 | 4.5 | 5.5 |
| Calcium soap % | 0.4 | 0.2 | 0.6 |
| Sodium soap % | 0.5 | 0.35 | 1.0 |
| Sodium soap:amine oxide mole ratio | 0.4 | 0.08 | 0.65 |
| Viscosity (cP) | 136 | — | 122 |

The compositions of Examples 83–85 exhibited no appreciable yield stress value.

EXAMPLES 86–89

Stable pourable liquid compositions were prepared in the same way as in the previous Examples, but using the following ingredients.

| | Example No. 86 Parts | 87 Parts | 88 Parts | 89 Parts |
|---|---|---|---|---|
| 30% aqueous cocodimethylamine oxide solution | 5.5 | 5.5 | 5.5 | 5.5 |
| sodium laurate | 1.0 | 1.0 | 1.0 | 1.0 |
| calcium laurate | 0.6 | 0.6 | — | — |
| calcium stearate | — | — | 0.6 | 0.6 |
| sodium toluene sulphonate | — | 0.75 | — | 0.75 |
| aqueous solution of sodium hypochlorite with 15% av. chlorine | 6.0 | 6.0 | 6.0 | 6.0 |
| Titanium dioxide (particle size less than 1 micron) | 0.1 | 0.1 | 0.1 | 0.1 |

After a storage testing period of 6–12 weeks at room temperature these compositions were still stable.

EXAMPLE 90

The following composition was prepared:

| | grams |
|---|---|
| sodium dodecylsulphate (SDS) | 1 |
| Ultra marine blue (UMB) | 0.03 |
| sodium hypochlorite solution (15% av. $Cl_2$) | 15–20 |
| water | to 100 g. |

The SDS was used as a 20% solution. The UMB was dispersed in the SDS solution using a Silverson mixer. The bleach was mixed with the remaining water, and then the SDS/UMB solution was added. The mixture was stirred slowly on an ice bath. A stringy precipitate was formed which contained the UMB. This was dispersed by rapid stirring at room temperature. A stable product was obtained.

EXAMPLE 91

The following composition was prepared:

| | grams |
|---|---|
| sodium tallow alcohol sulphate (TAS) | 1 |
| Ultramarine Blue | 0.03 |

-continued

| | grams |
|---|---|
| sodium hypochlorite solution (15% av. $Cl_2$) | 50 |
| water | to 100 g. |

A stable product was obtained.

EXAMPLE 92

The following composition was prepared:

| | grams |
|---|---|
| sodium tallow alcohol sulphate (TAS) | 1 |
| Ultramarine Blue | 0.03 |
| Sodium hypochlorite solution (15% av. $Cl_2$) | 42.5 |
| 1M aqueous solution of $CaCl_2$ | 1 ml. |
| water | to 100 g. |

This product was a stable liquid.

The addition of 1 g. of cocodimethylamine oxide to the formulations of Examples 91 and 92 improved the processing thereof, which was as follows:

The TAS was dissolved in water at 70°-75° C. The amine oxide (if used) was added, then the $CaCl_2$ solution (if used). The resulting solution was cooled to about 50° C., whereafter the bleach was added, and subsequently the UMB as a dispersion in water prepared with a Silverson mixer. The solution was cooled to room temperature with gentle stirring using cooling water.

EXAMPLE 93

A composition was prepared from the following ingredients:

| | grams |
|---|---|
| sodium-2-hydroxy-tetradecane-1-sulphonate (HTS) | 1 |
| UMB | 0.03 |
| sodium hypochlorite (15% av. $Cl_2$) | 15-20 |
| water | to 100 g. |

The HTS was dissolved in all the water by heating until boiling, then cooled with water until a precipitate started to form. The bleach and predispersed UMB were then added immediately and the product cooled to room temperature with gentle stirring.

EXAMPLES 94-96

The following compositions were prepared:

| | 94 | 95 | 96 |
|---|---|---|---|
| sodiumhexadecyl-1-sulphonate ($C_{16}H_{33}SO_3Na$) | 1 | 1 | 1 |
| Pigment (UMB) | 0.03 | 0.03 | 0.03 |
| bleach (sodium hypochlorite) | 10 | 20 | 30 |
| 1M $CaCl_2$ solution | — | 6 ml. | 10 ml. |
| water | to 100 g. | to 100 g. | to 100 g. |

The 1-sulphonate was dissolved in hot water (ca. 95° C.) and the $CaCl_2$ (if used) added. The solution was cooled to 50° C. and the bleach and predispersed pigment were added. It was then cooled to room temperature with gentle stirring.

EXAMPLE 97

The following composition was prepared:

| | grams |
|---|---|
| sodium dodecylbenzene-sulphonate (DOBS 102 (49.6% active)) | 10 |
| UMB | 0.03 |
| 1M $CaCl_2$ solution | 10 ml. |
| sodium hypochlorite solution (15% av. $Cl_2$) | 45-60 |
| water | to 100 |

The DOBS was dissolved in water at 70° C. The predispersed UMB was then added, followed by the calcium chloride solution. It was then cooled to 50°, whereafter the bleach was added, and cooled to room temperature with gentle stirring.

EXAMPLE 98

The following thickened composition was prepared:

| | grams | | |
|---|---|---|---|
| TAS | 1 | — | — |
| $C_{16}$-1-sulphonate | — | 1 | 1 |
| cocodimethylamine oxide (30%) | 3.65 | 3.65 | 3.65 |
| lauric acid | 0.9 | 0.9 | 0.9 |
| sodium hydroxide | 0.55 | 0.55 | 0.55 |
| sodium toluene sulphonate (40%)(STS) | 1.88 | — | 1.88 |
| sodium hypochlorite sol. (15% av. $Cl_2$) | 40 | 40 | 40 |
| water | | to 100 | |

The TAS and $C_{16}$-1-sulphonate were prepared as 10% solutions by dissolving in water at 70° and 95° C. respectively. The lauric acid, amine oxide and STS were dissolved at 70° C., and the lauric acid neutralized with the caustic soda. The TAS or $C_{16}$-1-sulphonate hot solutions were added, and the product cooled to 50° C. before adding the bleach and UMB. Then it was cooled to room temperature with stirring.

EXAMPLES 99-100

The following compositions were prepared:

| | 99 | 100 |
|---|---|---|
| $MgCl_2 . 6H_2O$ | 8.52 | 8.52 |
| UMB | 0.03 | 0.03 |
| Bleach (sod. hypochlorite) | 50 | 50 |
| 8M NaOH | 5 | 10 |
| water | | to 100 |

The $MgCl_2$ was dissolved in all the water and heated to 50° C. before adding the NaOH and bleach. The predispersed UMB was added and the product cooled to room temperature with gentle stirring.

EXAMPLE 101

The following composition was prepared:

| | grams |
|---|---|
| $CaCl_2 . 2H_2O$ | 5.28 |
| UMB | 0.03 |
| Bleach (sod. hypochlorite) | 60-70 |
| 8M NaOH | 2 |
| cocodimethylamineoxide (30%) | 2 |
| water | to 100 g. |

This product was prepared as in Examples 99-100, and the amine oxide was added to the $CaCl_2$ solution before the sodium hydroxide.

EXAMPLE 102

The following composition was prepared:

| | grams |
|---|---|
| $Al_2(SO_4)_3 . 16H_2O$ | 1.84 |
| bleach (sod. hypochlorite) | 13.3 |
| 2M NaOH | 6 |
| cocodimethylamineoxide (30%) | 3.3 |
| UMB | 0.03 |
| NaCl | 12 |
| Water | to 100 g. |

The $Al_2(SO_4)_3.16H_2O$ and NaCl were dissolved at 70° C. The amine oxide and UMB were added, followed by the sodium hydroxide. The solution was cooled to 50° C. before addition of the bleach, then the solutions were cooled rapidly to room temperature with gentle stirring.

EXAMPLES 103–104

The following compositions were prepared:

| | 103 | 104 |
|---|---|---|
| sodium orthophosphate $12H_2O$ | 7.6 | 11.4 |
| bleach (sod. hypochlorite) | 50 | 50 |
| 2M $CaCl_2$ solution | 15 ml | 15 ml |
| UMB | 0.03 | 0.03 |
| Water | to 100 | |

EXAMPLE 105

The following composition was prepared:

| | grams |
|---|---|
| sodium pyrophosphate . $10H_2O$ | 4.46 |
| bleach (sod. hypochlorite) | 50 |
| UMB | 0.03 |
| 1M $CaCl_2$ solution | 20 |
| Dowfax 2A1 (diphenylethersulphonate) | 1–2 |
| water | to 100 g. |

The products of Examples 103–105 were prepared as follows:

The sodium salt of the phosphate was dissolved in the water at 70° C., with Dowfax 2A1 present as required. The solution was cooled to 50° C. before addition of the pigment and bleach, followed immediately by the calcium chloride solution. The product was cooled to room temperature with gentle stirring.

EXAMPLE 106

The following composition was prepared:

| | grams |
|---|---|
| sodium metasilicate . $5H_2O$ | 2.12 |
| bleach (sod. hypochlorite) | 50 |
| 1M $CaCl_2$ solution | 15–25 mls |
| UMB | 0.03 |
| water | to 100 g. |

This product was prepared as in Example 12, except that when cooled to room temperature on a water bath it was given 5 minutes vigorous stirring.

EXAMPLE 107

The following composition was made:

| | grams |
|---|---|
| clay (Laponite SP) | 2 |
| bleach (sodium hypochlorite) | 66.6 |
| UMB | 0.03 |
| water | to 100 g. |

A 6% suspension of Laponite SP was prepared by mixing on a Silverson mixer for half hour. The UMB was introduced at this point. The solution was allowed to stand for 4 hours. The clay/UMB mixture was then stirred vigorously at room temperature and the bleach slowly added.

EXAMPLE 108

The following thickened composition was prepared:

| | grams |
|---|---|
| lauric acid | 0.9 |
| cocodimethylamine | 3.65 |
| sodium toluene sulphonate (40%) (STS) | 1.88 |
| Sodiumhypochlorite | 40 |
| UMB | 0.03 |
| $MgCl_2 . 6H_2O$ | 8.52 |
| 4M NaOH | 12 |
| water | to 100 g. |

The cocodimethylamine oxide, STS, $MgCl_2.6H_2O$ and lauric acid were dissolved in water by heating to 75° C. The sodium hydroxide was added, followed by the UMB dispersed in water, and cooled to 50° C. before adding the hypochlorite. It was then cooled to room temperature gentle stirring in a water bath.

EXAMPLE 109

The following composition was prepared:

| | grams |
|---|---|
| cocodimethylamine oxide | 4.5 |
| Sodium laurate | 0.55 |
| Free sodium hydroxide | 0.54 |
| Sodium silicate (42%) | 0.11 |
| water | to 40.00 |

A premix containing

| | |
|---|---|
| ultramarine blue | 0.05 |
| styrene/maleic anhydride copolymer (Latex E 284 ex Morton-Williams) | 1.25 |
| Water | to 20.00 |

was also prepared.

These mixtures were admixed using a high shear mixer with sodium hypochlorite 15% av. $Cl_2$ (40.00 g.). This product was stable for 2 months at 20° C.

We claim:

1. An aqueous colored liquid bleach composition, having a pH of at least 9.8 and having a yield stress value of less than 1 dyne per square centimeter at 20° C., comprising a chlorine bleach compound in an amount of 1–15% by weight of available chlorine, from 0.01–0.2% by weight of a particulate bleach-stable pigment having a particle size within the range of 0.1–50 microns, which is maintained in suspension by a flocculate dispersed in an aqueous medium, the flocculate filling at least 50% of the volume of the aqueous medium, said flocculate being obtained from 0.05–20% by weight of the composition of a precipitated organic floc-structure forming detergent active material, selected from the group consisting of a precipitated $C_{10}$–$C_{18}$ alkylsulfate, a precipitated $C_{10}$–$C_{18}$ alkane sulfonate, a precipitated $C_{12}$–$C_{18}$ alkylbenzene sulfonate, a precipitated calcium fatty acid soap, and mixtures thereof.

2. A composition according to claim 1, wherein the chlorine-bleach compound is sodium hypochlorite.

3. A composition according to claim 1, in which the particulate pigment is ultramarine blue.

4. An aqueous colored liquid bleach composition, having a pH of at least 9.8 and having a yield stress value of less than 1 dyne per square centimeter at 20° C., comprising a chlorine bleach compound in an amount of 1–15% by weight of available chlorine, from 0.01–0.2% by weight of a particulate bleach-stable pigment having a particle size within the range of 0.1–50 microns, which is maintained in suspension by a flocculate dispersed in an aqueous medium, the flocculate filling at least 50% of the volume of the aqueous medium, said flocculate being obtained from 0.05–20% by weight of the composition of a precipitated calcium soap of a fatty acid having from 8–22 carbon atoms.

5. A composition according to claim 4, in which the calcium soap is calcium stearate.

6. A composition according to claim 4, in which the amount of calcium soap present is from 0.05 to 10% by weight.

7. A composition according to claim 4, further comprising 0.1–3% by weight of an alkali metal salt of benzene-, toluene- or xylene-sulphonate.

8. A composition according to claim 4, in which the calcium soap flocculate is stabilized in dispersion by detergent micelles in solution in the aqueous medium.

9. A composition according to claim 8, in which the micelles are provided by a detergent micellar complex.

10. A composition according to claim 9, in which the detergent micellar complex comprises an amine oxide detergent and an alkali metal fatty acid soap.

11. A composition according to claim 10, in which the amine oxide is lauryldimethylamine oxide.

12. A composition according to claim 10, in which the alkali metal fatty acid soap is sodium laurate.

13. A composition according to claim 10, in which the amount of amine oxide present is from 0.3 to 5% by weight of the composition and the molecular ratio of alkali metal soap to amine oxide present is from 0.05:1 to 0.8:1.

14. A composition according to claim 8, having a viscosity of from 5 to 550 centipoise, as measured at 25° C. using a Haake rotary viscometer at a shear rate of 21 $sec.^{-1}$.

15. A composition according to claim 14, having a viscosity of from 20 to 400 centipoise.

16. A process for preparing a composition according to claim 1, which includes the step of precipitating the flocculate in the aqueous medium in situ in a manner known per se.

17. A process for preparing a composition according to claim 4, which includes the step of precipitating the calcium soap as a flocculate by adding an aqueous solution of a water-soluble calcium salt to an aqueous solution of an alkali metal salt of the corresponding fatty acid.

18. A process according to claim 17, in which the calcium salt is calcium chloride.

* * * * *